US005207509A

United States Patent [19]

Herbert

[11] Patent Number: 5,207,509

[45] Date of Patent: May 4, 1993

[54] MULTICHAMBER BAG

[75] Inventor: Reinhold Herbert, Weilrod, Fed. Rep. of Germany

[73] Assignee: Fresenius AG, Bad Homburg, Fed. Rep. of Germany

[21] Appl. No.: 847,601

[22] Filed: Mar. 5, 1992

[30] Foreign Application Priority Data

Mar. 7, 1991 [DE] Fed. Rep. of Germany ..... 4107223

[51] Int. Cl.[5] ..... B65D 30/22; A61B 19/00

[52] U.S. Cl. ..... 383/38; 206/219; 604/87

[58] Field of Search ..... 383/38, 39, 40, 59, 383/68; 206/219; 604/82, 83, 84, 85, 86, 87, 88, 89, 90, 91

[56] References Cited

U.S. PATENT DOCUMENTS

| | | | |
|---|---|---|---|
| 2,932,385 | 4/1960 | Bollmeier et al. | 206/219 |
| 3,294,227 | 12/1966 | Schneider et al. | 206/219 |
| 3,474,898 | 10/1969 | Montgomery | 206/219 |
| 3,545,671 | 12/1970 | Ross | 383/38 X |
| 3,809,224 | 5/1974 | Greenwood | 206/219 |
| 4,458,811 | 7/1984 | Wilkinson | 383/38 X |
| 4,805,767 | 2/1989 | Newman | 206/219 |
| 4,994,056 | 2/1991 | Ikeda | 604/87 X |

FOREIGN PATENT DOCUMENTS

| | | | |
|---|---|---|---|
| 132632 | 2/1985 | European Pat. Off. | 206/219 |

*Primary Examiner*—Allan N. Shoap
*Assistant Examiner*—Jes. F. Pascua
*Attorney, Agent, or Firm*—Omri M. Behr, Esq.; Matthew J. McDonald

[57] ABSTRACT

The invention relates to a multichamber bag (1), the bag chambers (2, 3) of which are separated via a separating means (4), the squeeze-off means (5) of which temporarily separates the bag contents. To avoid being restricted to specific sheet types in the use of the material for the multichamber bag, in the region of the subsequent mixing opening an elastic sheet strip is arranged which serves as seal on actuation of the squeeze-off means (5).

6 Claims, 1 Drawing Sheet

MULTICHAMBER BAG

DESCRIPTION

Figure 1:
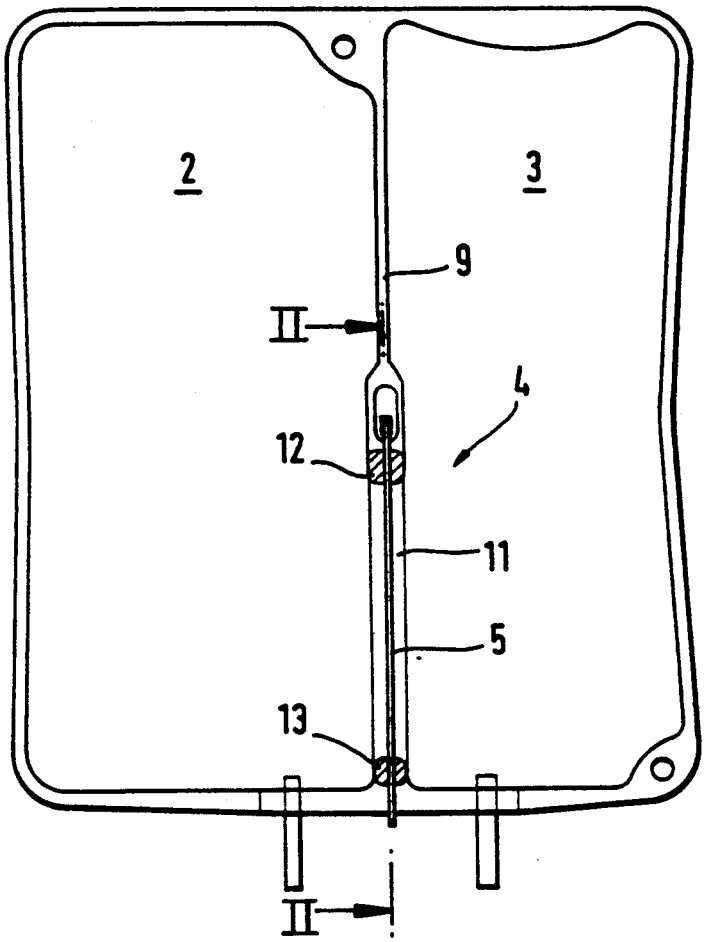

The invention relates to a multichamber bag.

Such a multichamber or two-chamber bag usually requires a separating means between the chambers or bags which reliably separates the contents of the chambers for example during the production and storage process and which is easy to open prior to use. As large a cross-section as possible should be freed.

At present, two systems are known as separating means:

One of said systems employs separating breaking parts of rigid breakable materials. These have the advantage of substantially universal usability but have disadvantages in so far as they free only a limited breaking or mixing opening and on breaking the separating means undesirable particle formation can occur.

The second type of separating means (DE 38 30 630 A1) is configured as squeeze-off system which for example by means of outer clips presses the sheets or foils of the bag for sealing and can be opened prior to use. The advantages of such squeeze-off systems lie in the possible large mixing opening which as a rule can be produced in particle-free manner. However, such systems are disadvantageous in so far as they are restricted to sheet materials for the bags which must have a high elasticity and temperature resistance in order to fulfill the desired separating effect.

The problem underlying the present invention is therefore to provide a multichamber bag which has a separating means which is constructed as squeeze-off means but which can be made universally with all types of sheets and foils.

The invention provides a multichamber bag with a squeeze-off separating means which combines the advantages of the known squeeze-off systems with the further advantage that it is applicable preferably to all sheets for the bags which consist of polyethylene or contain proportions of polyethylene.

Due to the fact that the sheet or foil strip is elastic, it can be used between the bag sheets to be pressed onto each other as sealing strip so that the desired sealing effect can be obtained independently of the material of the bags.

The subsidiary claims relate to further advantageous developments of the invention.

The elastic or resilient sheet strip is advantageously introduced at its end points into the subsequent mixing opening of the multichamber system and for this purpose for example a welding or sealing is conceivable.

Advantageously, the sheet strip consists of ethyl vinyl acetate (EVA). If a sheet or foil strip of this material is employed, the multichamber bag completed by the sheet strip can be treated with ionizing radiation effecting a crosslinking of the sheet strip material of EVA. This does not impair the sealing-in of the EVA sheet strip. However, in the ionizing radiation treatment the unsealed portion of the sheet strip in the subsequent mixing opening loses its sealability and is given good dimensional stability at high temperatures.

Due to these properties, the EVA sheet strip can be employed via an external fixing, for example a clip, as seal between the bag sheets for chamber separation. The elasticity of the EVA material facilitates the sealing. Even after the sterilization the separating means can be opened to mix the contents because the crosslinking prevents firm bonding to the sheets.

Advantageously, the squeeze-off geometry for example of the clip used as squeeze-off means may preferably be configured for pulling-up the sealing point.

Further details, features and advantages of the invention will be apparent from the following description of an example of embodiment with the aid of the drawings.

Figure 2:
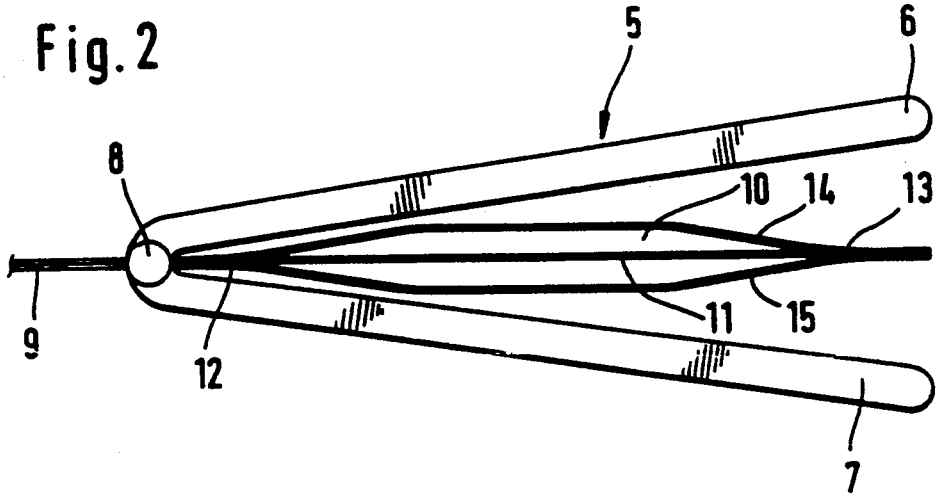

IN THE DRAWINGS:

FIG. 1 shows a schematically simplified illustration of an embodiment of a multichamber bag according to the invention, and FIG. 2 is an illustration corresponding to FIG. 1 along the line II—II of FIG. 1.

In FIG. 1 a multichamber bag 1 according to an embodiment of the present invention is illustrated which in the case of the example is formed as two-chamber bag having two bag chambers 2 and 3.

The substances contained in the bag chambers 2, 3 are for example separated from each other during the production and storing process via an openable separating means 4. The separating means 4 comprises a squeeze-off means 5 which is apparent in particular from FIG. 2 and which can be formed for example as clip having two arms 6 and 7 which are joined together via a joint 8.

It is further apparent from FIG. 1 that in a region of the bag seam 9 between the bag chambers 2, 3 in which the subsequent mixing opening 10 (FIG. 2) is formed a sheet strip 11 is arranged. The sheet or foil strip 11 is sealed at its ends 12, 13 for example into the mixing opening 10, overlapping being present between the bag seam 9 and the sheet strip 11 preferably consisting of EVA.

The arrangement of the sheet strip 11 between the bag sheets 14 and 15 is apparent in particular from the illustration of FIG. 2. The bag sheets 14, 15 here represent the bag wall regions which free and define the mixing opening 10 after opening of the clip 5.

According to a method for producing the multichamber bag 1 according to the invention after forming the bag chambers 2, 3 firstly the elastic sheet strip, preferably of ethyl vinyl acetate, is welded or sealed at its end points into the subsequent mixing opening 10 of the multichamber system. The multichamber bag 1 completed in this manner is then exposed in a further method step to an ionizing radiation which effects a crosslinking of the EVA material of the sheet strip 11. This does not however impair the sealing-in of the sheet strip 11. On the contrary, the unsealed portion of the sheet strip 11 in the subsequent mixing opening 10 is deprived of its sealability and is thereby given good dimensional stability at high temperatures.

If the clip 5 illustrated in FIG. 2 is pressed onto the bag walls 14 and 15, thereby squeezing the bag walls together, the sheet strip 11 provides the necessary sealing facilitated by the elasticity thereof.

Even after sterilization the separating means 5 can be opened to mix the contents of the bag chambers 2, 3 because the crosslinking of the EVA material of the sheet strip 11 prevents a firm bonding to the sheets 14, 15.

The multichamber bag 1 according to the invention has in particular the advantage of combining the advantage of a large mixing opening 10, which moreover can be formed in particle-free manner, with the advantage that for the bag chambers 2, 3 preferably sheets of polyethylene or sheets with proportions of polyethylene can be used.

The polymer EVA comprises generally a content of vinylacetate of 20–32% by weight, remainder ethyl group. For the further disclosure of said polymer EVA-material, the hot sealing of EVA with polyethylene and crosslinking by high energy irradiation, U.S. Pat. No. 4,561,110 is incorporated by reference.

I claim:

1. A package for separately storing and subsequently mixing a plurality of ingredients comprising a) a multichamber bag having a plurality of bag chambers, each of said chambers having first and second opposed bag walls of flexible material joined to each other by a seam around the periphery of said bag and b) openable separating means to define the bag chambers within said bag comprising i) a strip of elastic sheeting arranged between said first and said second bag walls and ii) an external clamping means to fit over said bag walls proximate the location of said strip, whereby the deformation of said strip by application of said clamping means temporarily seals the thus formed chambers from each other.

2. The package of claim 1 wherein said openable separating means further comprises an internal partial seam having two ends, partially separating said bag chambers from each other, one end of said internal seam being sealably joined to said peripheral seam, said elastic strip being joined at one end thereof to the remaining end of said internal seam and the other end thereof to said peripheral seam.

3. The package of claim 1 wherein said elastic strip is welded or sealed to said internal seam.

4. The package of claim 1 wherein the elastic strip comprises of ethyl vinyl acetate.

5. The package of claim 1 wherein said package has been subjected to ionizing radiation whereby the said elastic strip became crosslinked.

6. The package of claim 1 wherein the bag walls are made of a material selected from the group consisting of polyethylene sheets and sheets containing polyethylene.

* * * * *